United States Patent [19]

Britschgi et al.

[11] 4,447,334

[45] May 8, 1984

[54] METHOD FOR THE DEWATERING OF LUMP PEAT

[75] Inventors: Hugo Britschgi, Stalden; Burkard Rosenberg, Horw, both of Switzerland

[73] Assignee: Bell Maschinenfabrik Aktiengesellschaft, Kriens, Switzerland

[21] Appl. No.: 359,584

[22] Filed: Mar. 18, 1982

[30] Foreign Application Priority Data

Apr. 28, 1981 [CH] Switzerland ..... 2750/81

[51] Int. Cl.[3] ..... B30B 9/24

[52] U.S. Cl. ..... 210/783; 100/120; 100/152; 100/153; 100/154; 209/624; 210/386

[58] Field of Search ..... 210/386, 783, 400, 401; 209/1, 2, 624, 622; 100/35, 118, 119, 120, 151-154, 90, 96

[56] References Cited

U.S. PATENT DOCUMENTS

| | | | |
|---|---|---|---|
| 1,049,614 | 1/1913 | Sigler et al. | 100/120 |
| 1,476,407 | 12/1923 | McDougall | 100/118 |
| 3,805,692 | 4/1974 | Fischer | 100/120 |

*Primary Examiner*—Frank Sever

*Attorney, Agent, or Firm*—Robert A. Ostmann

[57] ABSTRACT

In method for the dewatering of naturally moist, coarse lump peat or of a similar material, the material is continuously fractured into particles to approximately 2-3 cm diameter and is dispersed onto a lower screen belt. With the leading in of a provided upper screen belt the material is conveyed between the two screen belts through a preliminary dewatering zone, where at a pressure which is only given through the tension of the screen belts in a loop on at least one pair of rolls, a homogeneous filter cake is produced. The latter is pressed in a subsequent dewatering zone of a number of pairs of nip rolls at a pressure increasing along the zone between screen belts, whereby in each case between the screen belt and the nip roll a pressure belt, equal in width to the screen belt, is carried long, consisting of an elastic, watertight material, but which is designed to receive and carry away the filtrate and to stabilize the material which is to be pressed. After the dewatering zone, the material arrives into a high pressure zone, where it is treated between screen belts between at least one pair of press rolls at a greater pressure than on the last pair of rolls of the dewatering zone.

8 Claims, 3 Drawing Figures

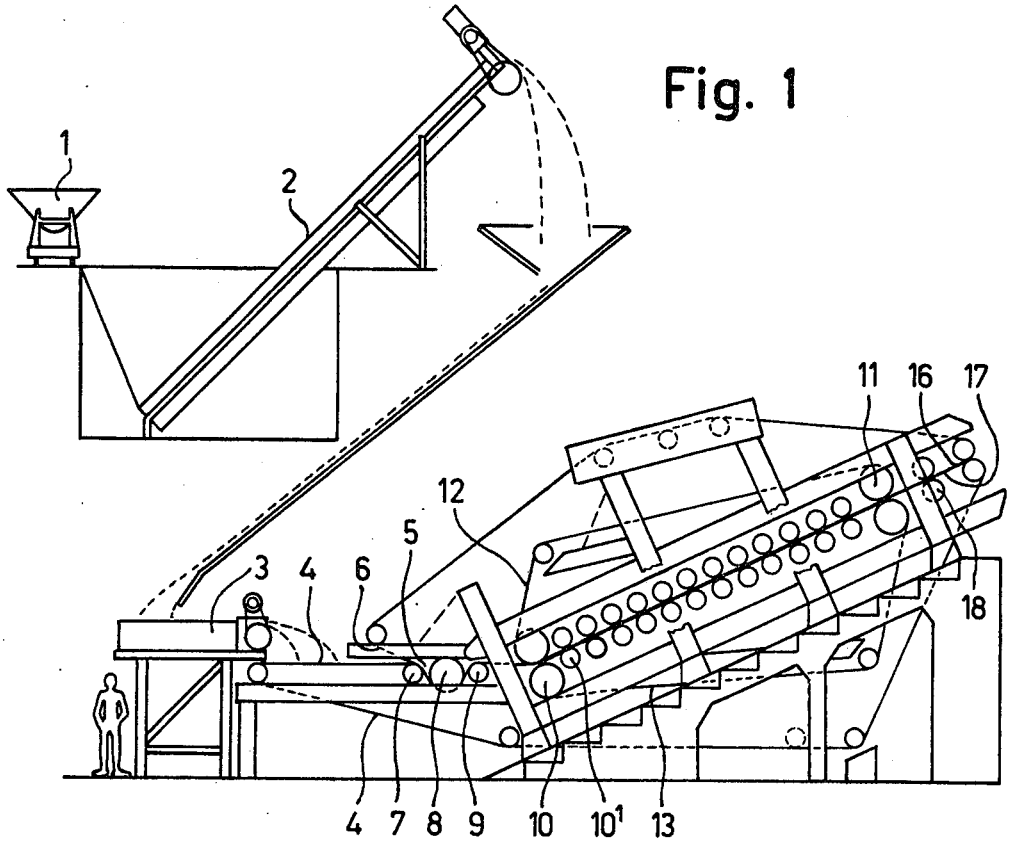
Fig. 1
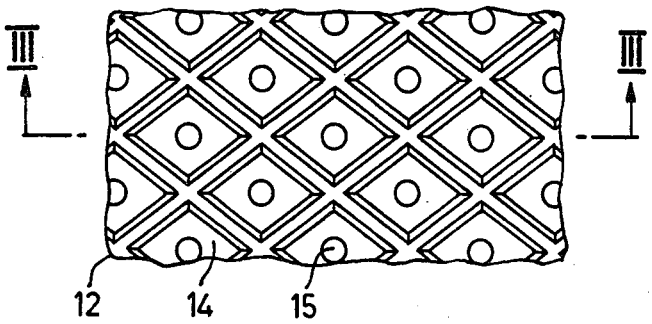
Fig. 2
Fig. 3
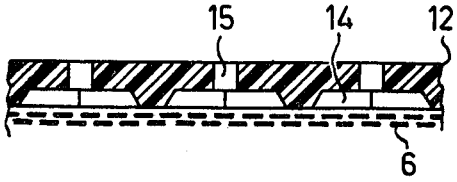

METHOD FOR THE DEWATERING OF LUMP PEAT

BACKGROUND OF THE INVENTION

The invention relates to a method for the dewatering, by means of pressing, of lump peat or of similar naturally moist, coarse lump material.

In the manner known to date, a naturally moist coarse lump peat, which has been obtained in an excavation locality is supplied for briquette pressing, where it is dewatered by pressing in cage-like chambers. This procedure can also be arranged semi-continuously, by assembling a number of cage-like chambers, which are successively filled, pressed and emptied. Relatively heavy and expensive facilities are required for this method, whereby, however, the product is not entirely satisfactory, for it is not homogeneous as regards the moistness and lump size. Through the high pressures applied, the peat is crushed, ie. it is destroyed in structure, so that too many fibres are broken.

Several other attempts at the mechanical dewatering of naturally moist lump peat did not lead to any better results. E.g., the U.S. Pat. No. 3,805,692 shows a press having an endless belt made of a flexible absorbent material on a central portion of which peat is continuously fed and side portions of the belt are then folded and lapped over the peat for passage in folded condition between a set of press rolls. Thereafter, a scraper opens the belt and scrapes the dried peat therefrom. This method suffers under susceptibility of the belt itself which, moreover, becomes stopped up or clogged with fines of the peat within short time.

SUMMARY OF THE INVENTION

The present invention was based on the problem of finding a method for the dewatering of lump peat or of a similar naturally moist, coarse lump material, by which a product would be obtained continuously and economically, and which is able to have a uniform structure, fibres which are preserved in the main, and an acceptable low residual moisture.

This problem is solved according to the invention in a method described in the introduction, for the dewatering of lump peat or of similar, naturally moist and coarse lump material through continuously operating in following successive process steps:

(a) fracturing of the material into particles to approximately 2–3 cm diameter, (b) dispersing of the particles breadthwise onto a lower screen belt, by which the strewn material is passed through a preliminary dewatering zone, where, covered with an upper screen belt which is brought in as provided, the material is passed between the two belts through a loop on at least one pair of rolls and is only pressed through the tension of the belts, (c) carrying the material through a dewatering zone between an upper and a lower screen belt through a series of successive pairs of nip rolls at a pressure which increases successively, whereby in each case parallel to the screen belt and between the screen belt and the roll a pressure belt is drawn along, which is equal in width to the screen belt, is elastic and watertight, but is designed to receive and carry away the water which has been squeezed out and to stabilize the material, (d) carrying of the material through a high pressure zone between an upper and a lower screen belt through a nip between at least one pair of rolls and at a higher pressure than that exerted by the final previous pair of rolls of the dewatering zone.

Through the treatment in the preliminary dewatering zone, a filter cake is formed, which is of homogeneous structure with uniform quantitative distribution and uniform water/solid ratio. Only this homogeneous, fixed and locally stabilized filter cake is subsequently further dewatered in a cascade of nips, without being crushed and without, for this reason, clogging the screens.

BRIEF DESCRIPTION OF THE DRAWING

In the following, the method according to the invention will be described and explained in further detail with the aid of a drawing.

In the drawing:

FIG. 1 shows a dewatering installation, designed to carry out the method according to the invention, in side view, FIG. 2 shows a pressure belt to receive and carry away the filtrate, in plan view and on an enlarged scale, FIG. 3 shows the pressure belt in longitudinal section along line III—III in FIG. 2.

DESCRIPTION OF THE PREFERRED EMBODIMENT

A naturally moist, coarse lump peat, which has been excavated in a peat locality, is loaded by a dump cart 1 onto a conveyor belt 2. The latter carries the lump peat onto a mixing and fracturing device 3. This mixing and fracturing device 3 is similarly constructed to a conventional manure spreader. With this device 3 the lump peat is fractured into particles or pieces to approximately 2–3 cm diameter. The fractured material is strewn by the device 3 breadthwise onto a lower screen belt 4. Already at this point the material partially loses its moistness, whereby the filtrate penetrates downward through the screen belt. Within the lower screen belt 4 the material travels towards a preliminary dewatering zone 5, before which a provided upper screen belt 6 is brought up to the lower screen belt 4. Between these two screen belts 4 and 6 the material passes the preliminary dewatering zone 5, in which the screen belts form a loop, driven on at least one pair of rolls. As constructed here, to form the loop three rolls 7,8 and 9 are provided. The looping on the individual rolls should form approximately 90°. The individual rolls 7,8 and 9 are arranged at a distance from one another, so that the pressure which is present is only obtained through the tension of the screen belts 4 and 6. In this preliminary dewatering zone the previously strewn carpet of peat, a loose mixture, is dewatered to a uniform dry content and equally distributed between the upper and the lower screen belts. In this way a homogeneous filter cake is produced with uniform quantitive distribution and with uniform water/solid ratio. This is achieved with a relatively low pressure. With the condition of the filter cake obtained in the preliminary dewatering zone, denoted by the carpet of peat being fixed or stablized, it is possible to treat this material further at a greater pressure, without its becoming crushed and without its being destroyed in structure. In this way the so-called milling or grinding of the material under greater pressure, the breaking of the fibres, is substantially prevented in the subsequent phases of treatment.

The pre-dewatered material now arrives into a pressing zone, the actual dewatering zone, where the major portion of the moisture is removed from the material. This pressing or dewatering zone is formed between its limiting pairs of rolls 10 and 11. Here the further successive dewatering takes place in a cascade of nips, which are formed by a series of pairs of nip rolls 101 and following, arranged in tandem up to the limiting roll 11. Along the series of pairs of nip rolls a constantly increasing pressure is applied. In this pressing zone, parallel to the lower screen belt 4 and the upper screen belt 6 in each case a pressure belt 12 or 13 is carried along. In each case the pressure belt is arranged parallel to the screen belt and between the screen belt and the respective nip roll. It is a structure of equal width to the screen belt. It is elastic and consists of a watertight material, ie. a material which is waterrepellent or does not absorb water, eg. of solid rubber.

These pressure belts 12 or 13 are designed to receive the water squeezed out from the material, the filtrate, and to carry it away. This measure makes it possible that even filtrate being obtained in the nip can penetrate through the screen belts, because is is received by the pressure belts in situ and can be carried away by them, so that no filtrate, but also no material to be dewatered, can accumulate in front of the nips.

An embodiment of a pressure belt 12 is represented in FIGS. 2 and 3 of the drawing. Here the concave chambers 14 can be seen, which are provided for the reception of the filtrate, and the holes 15, which are present for the evacuation or passage of the filtrate through the pressure belt. The material of the pressure belt is, in appropriate instances, rubber, in a quality and condition such that it does not, itself, absorb any water, filtrate. The concave chambers 14 are opened facing the screen belt 6 or the material to be pressed. In this way the material is held stable, ie. fixed, and the filtrate is evacuated in the shortest way possible from the pressing zone. This prevents the carpet of peat from being additionally dampened on its edges through the filtrate which would otherwise flow from the pressing centre to the edges. The bridges between the chambers stabilize the material locally, ie. they fix the material, preventing its displacement in any direction whatever. Advantageously, as is shown in FIGS. 2 and 3 the chambers 14 are arranged adjacent to one another, whereby the chambers in plan form have the shape of a rhombus, of which one axis runs parallel to the direction of motion of the pressure belt. With these elastic pressure belts at the same time the transfer of energy onto the screen belts is distributed over a long distance, which contributes substantially to the care of the screen belts. In terms of material, the pressure belts are in no way restricted to rubber as the material. Also other materials, in so far as they possess the postulated elasticity and moisture repellent property, could be used.

The material which has been dewatered and treated in the pressing zone is then conveyed between an upper screen belt 16 and a lower screen belt 17 in a high pressure pressing zone, which is formed by at least one pair of rolls 18. As constructed here, this high pressure zone is formed by two pairs of crushing rolls. In this zone the carpet of peat does not require any further fixing, so that there is no more need for any pressure belts here. Advantageously the press, in the region of the pressing or dewatering zone the the high pressure zone, is arranged at a maximum of approximately 25° to the horizontal, in direction of transportation straight or rising upward, so that the filtrate can be evacuated before the respective pressing points brushing against the nips, or more easily. In this it is ensured that the filtrate is evacuated from the individual places where it is collected, ie. separately from the individual nips, and that it is used, either directly or after an intermediate purification, to clean the screens. The possible purification of the filtrate is particularly necessary because of the fibre components collecting in the filtrate.

A setting of the desired pressure is possible on the individual pairs of nip rolls independently of each other. This is made possible by a variable control of the pressure on the individual pairs of rolls, and/or by roll covers differing in hardness. In this the elements generating the pressure force are arranged on the lower rolls in each case, and in this way the exchange of screen and pressure belts is simplified substantially.

Advantageously the alteration of pressure, or of the effect of pressing on the individual pairs of nip rolls is effected by transposing of the respective upper roll on the pair in the direction of or against the direction of motion of the belts. I.e., that the points of rotation of the rolls forming the nip are arranged on a line, which is oblique to the line of the belts.

Care must be taken that screen- and pressure-belts move at an equal speed to each other. In order to ensure this, both the lower and upper screen- and pressure-belts in each case are driven by their own motor, but in synchronism.

It is also conceivable that the pressure belts described are mounted directly against the individual nip rolls, wound around them. In this, of course, provision would have to be made for the evacuation of the filtrate through the respective roll surface into the interior of the roll and out from there.

We claim:

1. A method of continuously dewatering lump peat or similar naturally moist and coarse lump material by pressing, comprising the steps of:

a. providing a dewatering apparatus including a preliminary dewatering zone comprising upper and lower screen belts which travel a loop on at least one pair of rolls, a main dewatering zone comprising upper and lower screen belts which travel through the nips of successive pairs of rolls, and an elastic watertight pressure belt interposed between each screen belt and the rolls and having the same width as, and being designed to receive and carry away water expressed through, the associated screen belt, and a high pressure zone comprising upper and lower screen belts which travel through the nip or at least one pair of rolls;

b. fracturing the material to be dewatered into particles of approximately 2–3 cm diameter;

c. dispersing said particles breadthwise onto the lower screen belt of the preliminary dewatering zone and carrying the strewn material through this zone between the two belts thereof so that it is pressed only through the tension of the belts;

d. carrying the material leaving the preliminary dewatering zone through the main dewatering zone between the belts thereof and subjecting it to successively increasing pressure in the nips of the rolls of the zone, whereby water is pressed from the material and transferred into the pressure belts; and e. carrying the material leaving the main dewatering zone through the high pressure zone between the screen belts thereof and subjecting it to a higher pressure in the nip or nips of this zone than that exerted by the last pair of rolls of the main dewatering zone.

2. Method according to claim 1, in which in the main dewatering zone the treated material is conveyed along a line which rises a maximum of approximately 25° to the horizontal in the direction of transportation.

3. Method according to claim 1, in which the filtrate is evacuated separately from the individual points at which it accumulates and is used either directly or after an intermediate purification for the cleaning of the screens.

4. Method according to claim 1, in which the increasing pressure on the individual pairs of rolls of the main dewatering zone is obtained through more and more harder roll cover on subsequent roll pairs and/or through a variable controlling of the pressure via the lower rolls of the pairs of nip rolls.

5. Method according to claim 1, in which the alteration of the pressure, or of the effect of pressing on the individual pairs of rolls is effected through posing of the upper roll to the lower roll of the pair in the direction towards or against the direction of motion of the belts.

6. Method according to claim 1, in which the lower belts, like the upper belts, are driven in synchronism, for relative parallelity of their movement, so that all belts move at an equal speed.

7. Method according to claim 1, in which concave chambers are provided in the pressure belts, open facing the screen belt, to receive the water which has been pressed out, and that holes lead out of these chambers to evacuate the water.

8. Method according to claim 1 or 7, in which in the pressure belts concave chambers are provided, bordering on to each other, which in plan form have the shape of a rhombus, of which one axis runs parallel to the direction of motion of the pressure belt.

* * * * *